US007623669B2

(12) United States Patent
Ambourn

(10) Patent No.: US 7,623,669 B2
(45) Date of Patent: Nov. 24, 2009

(54) SIMPLIFIED AMPLIFIER PROVIDING SHARING OF MUSIC WITH ENHANCED SPATIAL PRESENCE THROUGH MULTIPLE HEADPHONE JACKS

(75) Inventor: Paul R. Ambourn, Phoenix, AZ (US)

(73) Assignee: Upbeat Audio, Inc., Grand Haven, MI (US)

( * ) Notice: Subject to any disclaimer, the term of this patent is extended or adjusted under 35 U.S.C. 154(b) by 1013 days.

(21) Appl. No.: 11/090,090

(22) Filed: Mar. 25, 2005

(65) Prior Publication Data

US 2006/0215848 A1 Sep. 28, 2006

(51) Int. Cl.
*H04R 1/10* (2006.01)
*H04R 3/00* (2006.01)

(52) U.S. Cl. ..... 381/120; 381/74; 381/309; 381/310; 381/17; 381/18; 381/1

(58) Field of Classification Search ..... 381/74, 381/77, 80, 120, 309, 310, 17, 18, 1
See application file for complete search history.

(56) References Cited

U.S. PATENT DOCUMENTS 3,745,254 A * 7/1973 Ohta et al. ..... 381/18
4,097,111 A * 6/1978 Martin ..... 439/638
4,388,494 A * 6/1983 Schone et al. ..... 381/1
4,412,106 A * 10/1983 Pavel ..... 381/309
4,495,637 A * 1/1985 Bruney ..... 381/1
4,908,858 A * 3/1990 Ohno ..... 381/1
4,910,778 A * 3/1990 Barton ..... 381/1
5,661,812 A * 8/1997 Scofield et al. ..... 381/309
5,692,050 A * 11/1997 Hawks ..... 381/1
5,812,683 A * 9/1998 Parker et al. ..... 381/74
6,144,747 A * 11/2000 Scofield et al. ..... 381/309
6,928,175 B1 * 8/2005 Bader et al. ..... 381/123
6,975,731 B1 * 12/2005 Cohen et al. ..... 381/74
7,095,862 B2 * 8/2006 Stinnett et al. ..... 381/120
7,391,876 B2 * 6/2008 Cohen et al. ..... 381/309
2001/0050993 A1 * 12/2001 Douglas ..... 381/71.6
2003/0142834 A1 * 7/2003 Stinnett et al. ..... 381/74

* cited by examiner

*Primary Examiner*—Vivian Chin
*Assistant Examiner*—Daren Vaughn
(74) *Attorney, Agent, or Firm*—Donald J. Ersler

(57) ABSTRACT

A personal listening device used in connection with the amplification of signals for enhancing the perceived quality and ambiance of sound heard by listener using stereo headphones or small speaker systems utilizes a difference signal that is cross-fed between stereo channels. The invention provides a perception of spatial presence in music sound when used with either stereo headphones or small speaker systems. The circuitry, wiring and packaging provide for multiple output jacks allowing for convenient sharing of the enhanced output signal from a personal listening device with other persons using headphones. The invention provides effects similar to stereo enhancement, surround sound, and psychoacoustic imagery in a small, inexpensive package for enhancing a user's audio experience.

10 Claims, 6 Drawing Sheets

SIMPLIFIED AMPLIFIER PROVIDING SHARING OF MUSIC WITH ENHANCED SPATIAL PRESENCE THROUGH MULTIPLE HEADPHONE JACKS

FIELD OF THE INVENTION

This invention relates to the art of electronic music reproduction and more particularly to the processing and amplification of electronic musical signals in a manner such as to enhance the perceived quality and ambiance of the sound heard by a listener using stereo headphones particularly, and also with small speaker systems. Stereo enhancement, surround sound, spatial presence, and psychoacoustic imagery are terms used in the industry to describe effects similar to those achieved by specific sections of the circuitry of this invention. The circuit of the invention utilizes op-amps, resistors, capacitors and other electronic components to develop a difference signal that is used to enhance the quality of the music when listened to with headphones. The packaging and circuitry provides for convenient sharing of music between friends.

BACKGROUND OF THE INVENTION

A user of stereo headphones often perceives simple monaural or a pure stereo source of music played through headphones as emanating from a point somewhere between the two headphones which, when the headphones are being worn, is somewhere inside their own head. Even if the location of the source is not perceived as being from within one's own head, the sound is often perceived as unnatural and fixed at a location that is not like what is felt to be normal compared to what is expected when the same music is listened to with a speaker system and also unlike what is desired by the sound engineer or artist who recorded the music. Undesirable effects such as these are more pronounced using headphones than with larger speaker systems because sound emanating from a speaker system is typically reflected and dampened by multiple walls or other objects which surround the listener, and this bouncing and mixing of signals provides for a presence that is typically more pleasing and natural sounding than that heard when a simple stereo amplifier is used to drive stereo headphones. The perception of the location of the source and the pleasantness of that sound when listening with headphones is a complex issue that is a result of the signal processing effects and/or techniques which have been found to be pleasing to a typical listener. These pleasing effects have often been measured and selected by empirical means, i.e., selecting them based upon some predetermined standard.

In general, the desired effect of the signal processing is to move the perceived source of the sound away from the apparent point halfway between the headphones, to places which are some distance from the listener and which may be located either in front of or behind the listener. Often, different frequencies or instruments with different sounds are perceived to be emanating from different locations.

In a recording studio, when music is recorded, there are typically more than two tracks or signals recorded when a performance is being played by musicians for recording. A typical number of tracks may be 32 or 16. It is sometimes the case that all the tracks are not recorded at the same time. A trumpet player may be recorded on one track, the bass drum on another, a vocalist or backup singer may be on other tracks and in similar fashion tracks are assigned for other instruments or sounds. The decision as to which sound or sounds are placed on each track is up to the recording engineers. In order to produce a recording for distribution to the public, these tracks are then mixed together to form a recording with a smaller number of tracks, typically two for stereo, in which the levels of the different tracks are selected by the recording engineer or producer and then mixed and phased onto the smaller number of tracks to achieve the desired sound. The same track may appear at different levels on more than one channel of the production output channels. This process is usually called the mix-down process. Since the number of tracks that existed originally is larger than the result after the mix-down there is typically a loss of information, that is, not all of the musical signals present in all 32 tracks (for example) will be present in the final, typically stereo, channels. The levels and sounds chosen for inclusion, and the phasing of those signals on the production output is largely an art as these levels are selected by practical experience and artistic feeling.

When played back in a stereo environment, the two channels are typically described as LEFT and RIGHT, or L and R channels, respectively. These two channels are typically played through the left and right speakers of a stereo speaker system, or through the left and right headphones of a headphone system. When played through speakers, the source of the sound that will be perceived by a typical listener can be predictably moved by the recording engineer to any point between the two speakers during the mix-down by making the level of sound from a chosen track louder on one speaker than the other. If the left or "L" channel is louder the signal will appear to move towards the left or "L" speaker. If the levels are equal between "L" and "R" the sound will typically be perceived as being located near the center point between the speakers. When listening with headphones, however, moving the perceived source of sound is more difficult, and typically requires circuitry which adjusts the phase or level of signals in an attempt to achieve the same or similar effects to that which are achieved more easily or naturally with actual speakers in a room with walls, a ceiling and a floor. The translation and/or prediction of what is individually perceived by the listener is not always completely predictable.

It is therefore a broad object of this invention to improve the perceived sound of a personal stereo audio system utilizing a circuit for amplification which includes feedback that is based upon the difference between the LEFT and RIGHT channels of the stereo signal. It is a second broad object of the invention to implement the audio enhancement circuit in a manner which is simpler than that used in prior art implementations of circuits with similar capabilities. It is a third broad object of the invention to implement a circuit that is more reliable than that of the prior art. It is a fourth broad object of the invention to provide for the sharing with another listener of the enhanced stereo sound from a personal listening device incorporating the circuit.

The circuit is intended primarily for use in providing a better perceived quality of sound when listening to a stereo audio signal with headphones and also to provide for the sharing of that enhanced stereo audio signal with another headphone listener. The circuit can also be used as part of small stereo sound systems such as might be found attached to a personal computer or other personal listening devices. The circuit utilizes the difference signal formed as the difference in magnitude of the LEFT and RIGHT stereo signal. This difference signal, when fed at varying levels and phasing into the mix of sound for each ear in a headphone, has been found to result in a movement in the perceived source of the sound and provides for an overall enhancement of the listening experience. The exemplary circuit of the invention uses fixed values for forming the cross-feed signal which has been determined empirically to be good for a majority of listeners while maintaining the simplicity of the circuitry. The circuitry of the invention is also simpler than that of the prior art resulting in the potential for increased reliability and lower production cost.

The invention also provides capability for the sharing of the audio signal with another person using headphones by providing multiple output headphone jacks.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DESCRIPTION OF THE PREFERRED EMBODIMENT(S)

Figure 1:
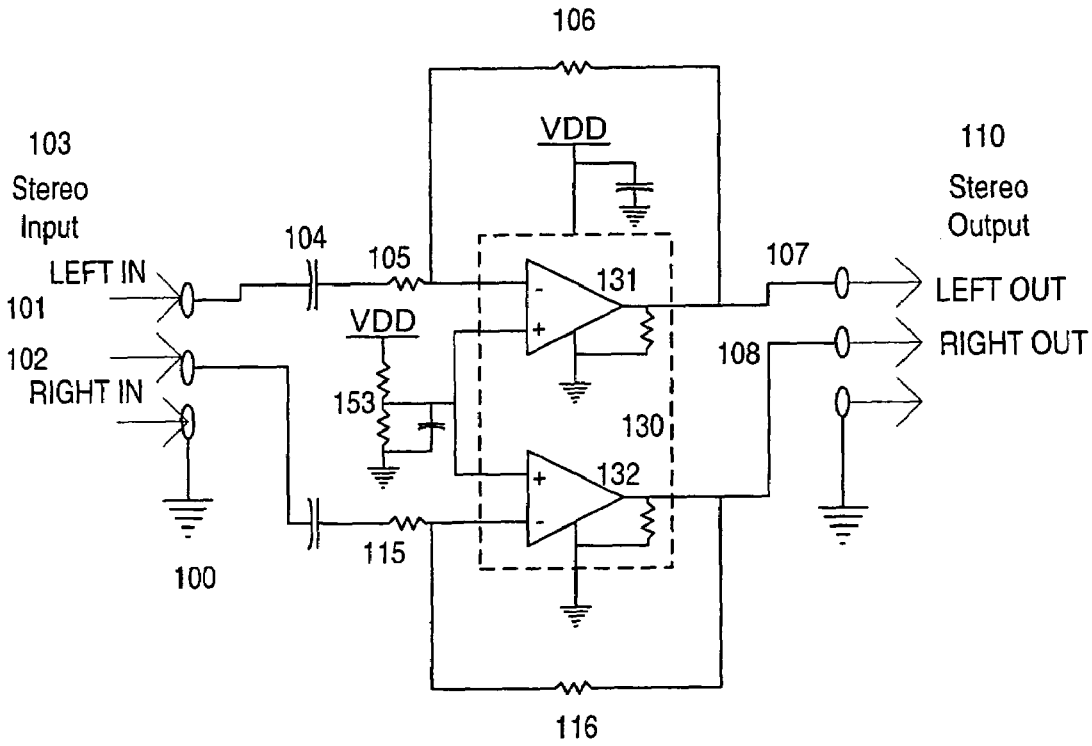
FIG. 1 (PRIOR ART)
FIG. 1 is a prior art block diagram showing a typical audio amplifier circuit.

The figures of the drawing illustrate some examples of sound enhancement circuitry and an exemplary environment in which the invention finds application. Those skilled in the art will recognize that the application of the invention does not preclude continued improvement in algorithms, implementation, or in the choice of values specific to the mathematics which underlie the operation of the circuit.

FIG. 1 is a prior art block diagram showing a typical audio amplifier circuit utilizing operational amplifiers. A stereo input signal 103 consisting of a LEFT 101 and a RIGHT 102 signal feeds into the amplifier circuit. A ground reference signal 100 also is represented. The amplification for the LEFT and RIGHT input signals is achieved using two operational amplifiers 131 and 132, contained in a single package 130. For the LEFT signal, two resistors 105 and 106 determine the gain of the operational amplifier 131 circuit. Similarly, two resistors 115 and 116 determine the gain of the RIGHT 132 amplification. The reference voltage 153 for both operational amplifiers is set half-way between the power supply voltage VDD and ground. The output stereo signal LEFT 107 and RIGHT 108 signals after amplification are depicted. This operational amplifier circuit is typical of the prior art, and is commonly used in the industry. Various values of resistors and capacitors can be chosen by a person skilled in the art to achieve predictable filtering and gain characteristics.

Figure 2:
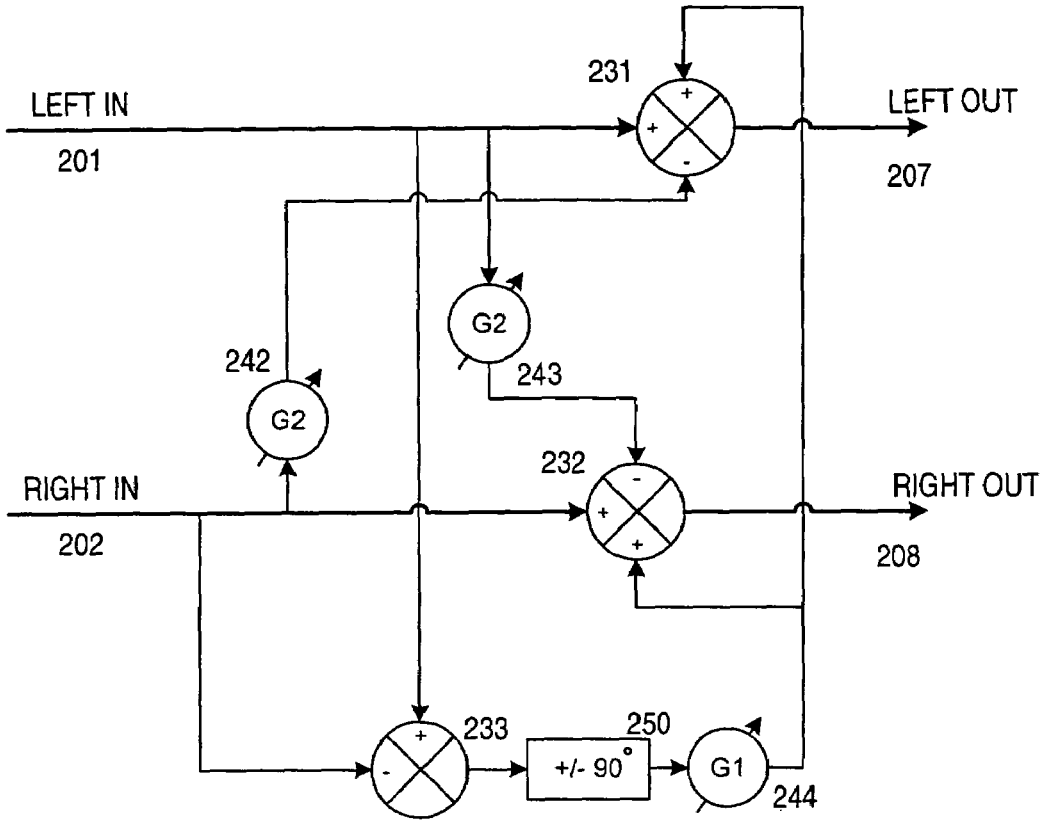
FIG. 2 (PRIOR ART)
FIG. 2 is a prior art block diagram showing a prior art circuit for stereo enhancement which utilizes difference circuitry, a plurality of variable gain control potentiometers, and a phase shifter to achieve a stereo enhancement effect.

FIG. 2 is a prior art block diagram showing a circuit for stereo enhancement from U.S. Pat. No. 4,910,778 which utilizes difference circuitry, a plurality of variable gain control potentiometers, and a phase shifter to achieve a stereo enhancement effect. The LEFT 201 and RIGHT 202 signals are fed in positive form into a summation circuit for the LEFT channel 231 and another for the RIGHT channel 232. The LEFT 201 and RIGHT 202 signals are also cross-fed into the negative input of the same summation circuits 231 and 232 with the LEFT signal passing through gain control 243 and the RIGHT signal passing through gain control 242. The gain control 242 for the RIGHT signal controls the level of RIGHT signal mixed into the LEFT summation circuit, and gain control 243 for the LEFT signal controls the level of LEFT signal mixed into the RIGHT summation circuit. A third summation circuit 233 with one positive and one negative input forms a DIFFERENCE signal which is LEFT IN minus RIGHT IN. This signal is fed through a phase shifter 250 which allows an adjustable phase shift of up to plus or minus 90 degrees. The output of the phase shift 250 is then fed through a gain control 244 and then fed into the LEFT 231 and RIGHT 232 summation circuits. The equation for the output LEFT signal 207 is thus:

$$\text{LEFT OUT}=\text{LEFT IN}+(G2*\text{RIGHT IN})+Gi*((\text{LEFT IN}-\text{RIGHT IN})\text{shifted in phase}).$$

Similarly for the output RIGHT signal 208 the equation is:

$$\text{RIGHT OUT}=\text{RIGHT IN}+(G2*\text{LEFT IN})+Gi*((\text{LEFT IN}-\text{RIGHT IN})\text{shifted in phase}).$$

This crossing and mixing of the DIFFERENCE between the LEFT and RIGHT signal into the LEFT and RIGHT signals themselves is referred to as "cross-feed".

Figure 3:
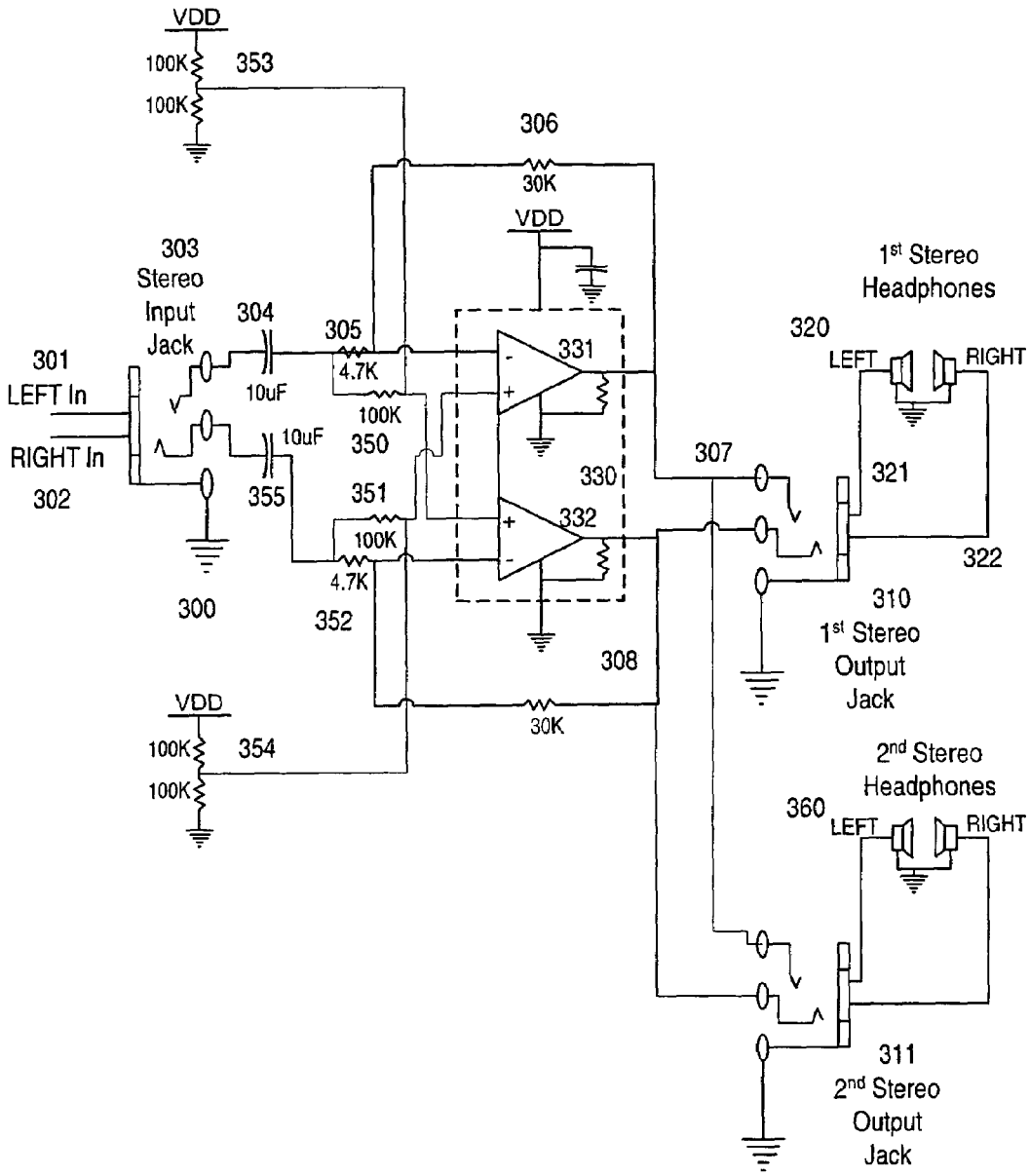
FIG. 3 is a block diagram of an exemplary circuit for stereo enhancement which illustrates certain main principles of the invention implementing symmetric cross-feed of fixed gain and biasing of LEFT and RIGHT op-amps for balanced operation and for driving of multiple output headphone jacks.

FIG. 3 is a block diagram of an exemplary circuit for stereo enhancement which illustrates certain main principles of the invention. LEFT IN 301 and RIGHT IN 302 are input stereo signals which are routed to the internal circuit through a stereo input jack 303. The stereo input jack has three contacts for LEFT, RIGHT, and ground 360 connection. The stereo input jack is the connection point to the device for providing an input signal connected by a cord to the output of a personal listening device. The LEFT IN input connection is isolated from the internal circuitry by a 10 microfarad (uF) capacitor 304 and in similar manner for RIGHT IN. Operational amplifiers 331 and 332 are contained within a single package 330. Power, VDD and ground are also provided to the package. The LEFT signal is connected to a resistor 305 which connects to the negative input to the op-amp 331. The gain of the circuit is determined by resistors 305 and 306. The reference voltage for the LEFT and RIGHT operational amplifiers is on the positive side of the inputs to the operational amplifiers and is formed by resistor divider networks 353 and 354.

The output of the LEFT op-amp 331 is the signal 307 which is connected to the output stereo jacks 310 and 311. The output of the second op-amp 332 is signal 308 which is connected to the RIGHT connector on the stereo output jacks 320 and 360. These output stereo jacks provide the connection method for routing the output signal to stereo headphones 320 and 360. The LEFT and RIGHT signals of the first headphone cord are marked as 321 and 322 respectively. The second stereo headphone 360 is connected through the second stereo output jack 311 in parallel with the first stereo headphones 320. In the immediately preceding description when the RIGHT circuitry is not described it is analogous to the LEFT circuitry.

FIG. 3 also depicts cross-feed circuitry which implements the mixing of the LEFT signal with the RIGHT signal, and also the RIGHT signal with the LEFT. For formation of the LEFT OUT signal, the LEFT input signal is connected through capacitor 304 and series resistor 305 to the negative input of op-amp 331. The RIGHT input signal, after going through an isolation capacitor 355 is connected through a resistor with larger value 351 and then to the positive input to op-amp 331. The LEFT OUT signal is thus directly proportional (gain as determined by resistors 305 and 306) to:

(the RIGHT IN signal 302 multiplied by a gain determined by resistors 306 and 351) minus (the LEFT IN signal 301)

This equation has an effect on the perceived sound which is similar to the equation in the description of FIG. 2 which was:

$$\text{LEFT OUT}=\text{LEFT IN}+(G2*\text{RIGHT IN})+G1*((\text{LEFT IN}-\text{RIGHT IN})\text{shifted in phase}).$$

This circuit, although mathematically quite different, has a similar good effect and has the advantage of being simpler to implement. It is also less noisy because it requires only one op-amp for each side of the stereo signal, and fewer other discrete components. Considering the LEFT half of the stereo circuit feeding op-amp 331, the values of the normal input resistor 305 having exemplary value of 4.7 k Ohms, the feedback resistor 306 having exemplary value of 30 k Ohms, and the crossover input resistor 351 having value of 100 k Ohms and feeding from the RIGHT input circuitry into the LEFT amplifier 331 were all determined empirically, while staying within manufacturer's guidelines for the operational amplifier. The analogous resistors for the RIGHT half of the stereo circuit affecting op-amp 332 are approximately equivalent to those for the LEFT half (within tolerances of the resistors chosen for implementation).

Overall, the resistors are chosen to achieve good gain within limits of the op-amp, and good sound determined by playing music and estimating its "goodness" at varying percentages of cross-feed (the gain of the cross-feed signals). It was found by empirical testing that a cross-feed value of about five percent of the normal input gain achieved a pleasing overall effect. This value of five percent is approximated by the resistor values of 4.7 k Ohms for the input resistance of the "normal" signal and a 100 k Ohm resistance for the cross-feed signal. These are the values depicted in FIG. 3 for resistors 305 and 351 respectively for the LEFT amplifying circuit. For the RIGHT amplifying circuit these are resistors 352 and 350, respectively. It was found that the pleasant effect of the cross-feed signal was apparent with resistor values of between about three to ten percent of the input signal, when judgement was passed upon a variety of musical programs, with a nominal value of five percent being good across a broad range of musical programs.

Figure 4A:
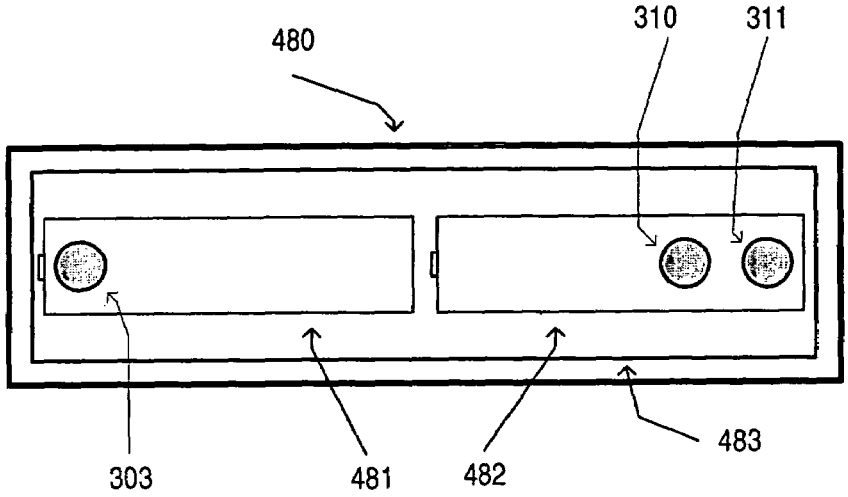
FIGS. 4A, 4B, 4C are block diagrams of exemplary packaging of the amplifying and enhancement circuitry including a stereo input jack and stereo output headphone jacks with power for the internal circuitry being supplied by batteries contained in brackets arranged such that the batteries are placed end to end in a manner such that the overall package is perceived as being a "bump" in the cable connecting a personal listening device to the headphones.
Figure 4B:
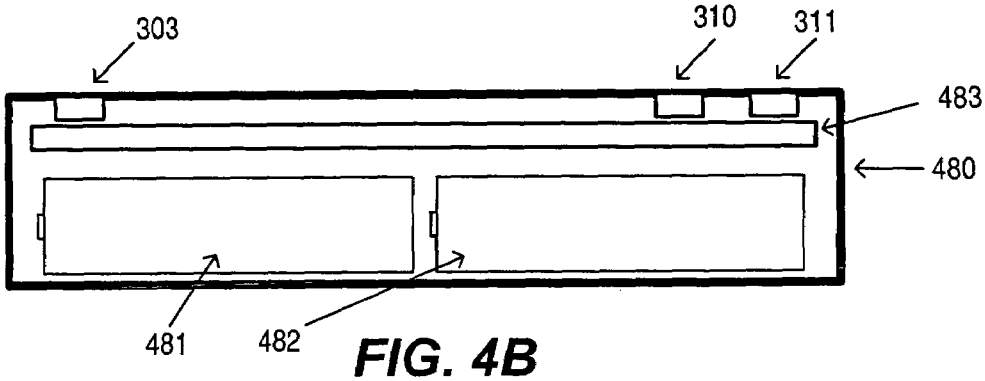
Figure 4C:
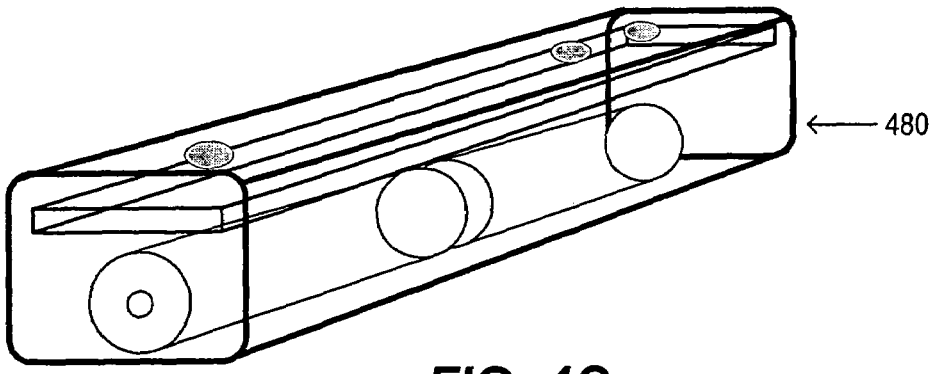

FIGS. 4A, 4B, 4C show pictorial diagrams of exemplary packaging with FIG. 4A being a top view, FIG. 4B being a front view, and FIG. 4C being a three-dimensional pictorial diagram of the amplifying and enhancement circuitry including a stereo input jack 303 and stereo output headphone jacks 310 and 311 with power for the internal circuitry being supplied by batteries 481 and 482 contained in brackets arranged such that the batteries are placed end to end in a manner whereby the case 480 of the overall package is perceived as being a lump in the cable connecting a personal listening device to the headphones. The stereo input jack 303 and the stereo output jacks 310 and 311 are mounted connected to the circuit board 483 which holds the circuitry of the amplifier circuit and associated components. The overall package is rectangular with length typically at least two times the width. The stereo input jack is at one end of the package or case 480, and the stereo output jacks are at the other end in a manner such that the package is perceived as a "lump in the cable" when an input cord is plugged into the stereo input jack, and any output cord is plugged into one of the stereo output jacks. This packaging approach allows the device to be carried unobtrusively while still providing the desired functionality. This is a benefit because many personal listening devices are small and designed to be carried unobtrusively so the described packaging depicted in FIGS. 4A, 4B, 4C contributes towards that overall goal.

Figure 5C:
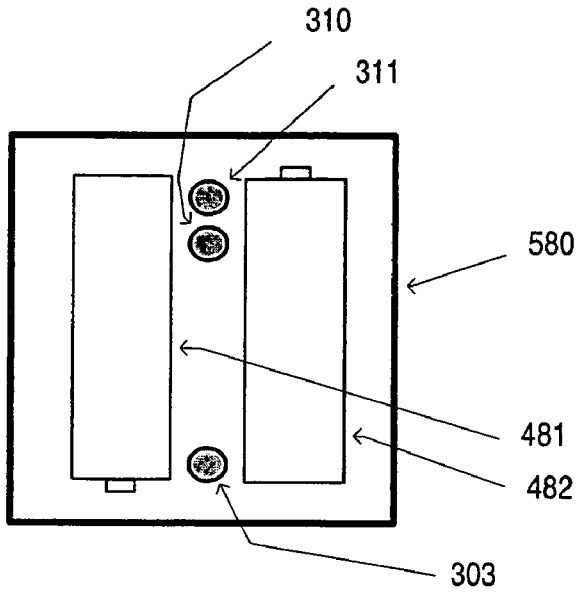
FIGS. 5A, 5B, 5C are block diagrams of exemplary packaging of the amplifying and enhancement circuitry including a stereo input jack and stereo output headphone jacks with power for the internal circuitry being supplied by batteries held in brackets positioned such that the batteries are side by side in a manner that the overall package is a small compact unit easily placed in a pocket or purse with the cords for the headphones running to and from the amplifying device.
Figure 5B:
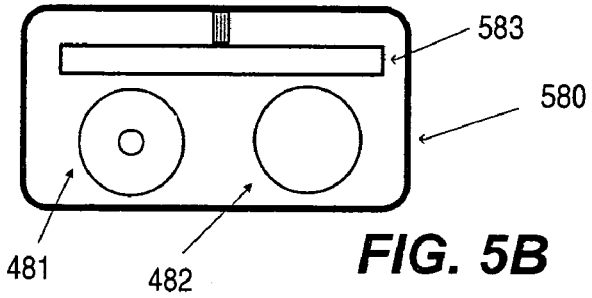
Figure 5A:
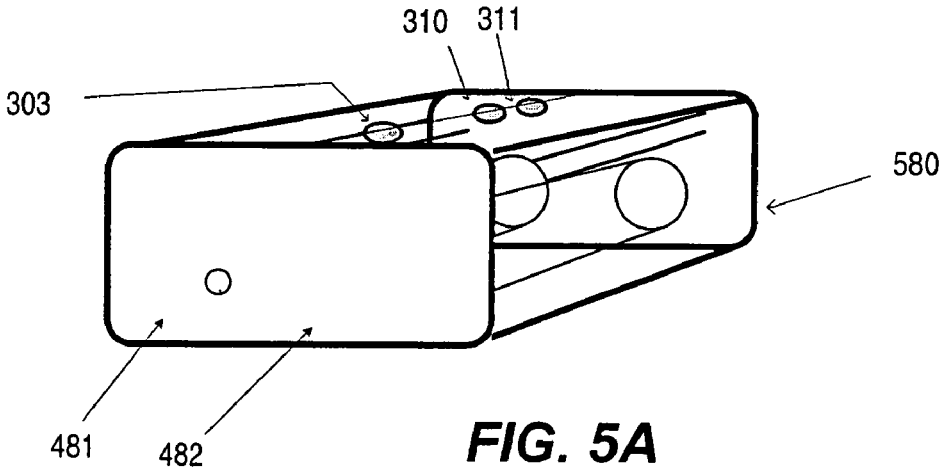

FIGS. 5A, 5B, 5C show exemplary packaging with FIG. 5A being a top view, FIG. 5B being a front view, and FIG. 5C being a three-dimensional pictorial diagram of the case 580 of the amplifying and enhancement circuitry including a stereo input jack 303 and stereo output headphone jacks 310 and 311 connecting to circuit board 583 with power for the internal circuitry being supplied by batteries 481 and 482 held in brackets positioned such that the batteries are side by side in a manner that the overall package is a small compact unit easily placed in a pocket or purse with the cords for the headphones running to and from the amplifying device. The overall package is rectangular with a length typically less than twice the width.

Figure 6:
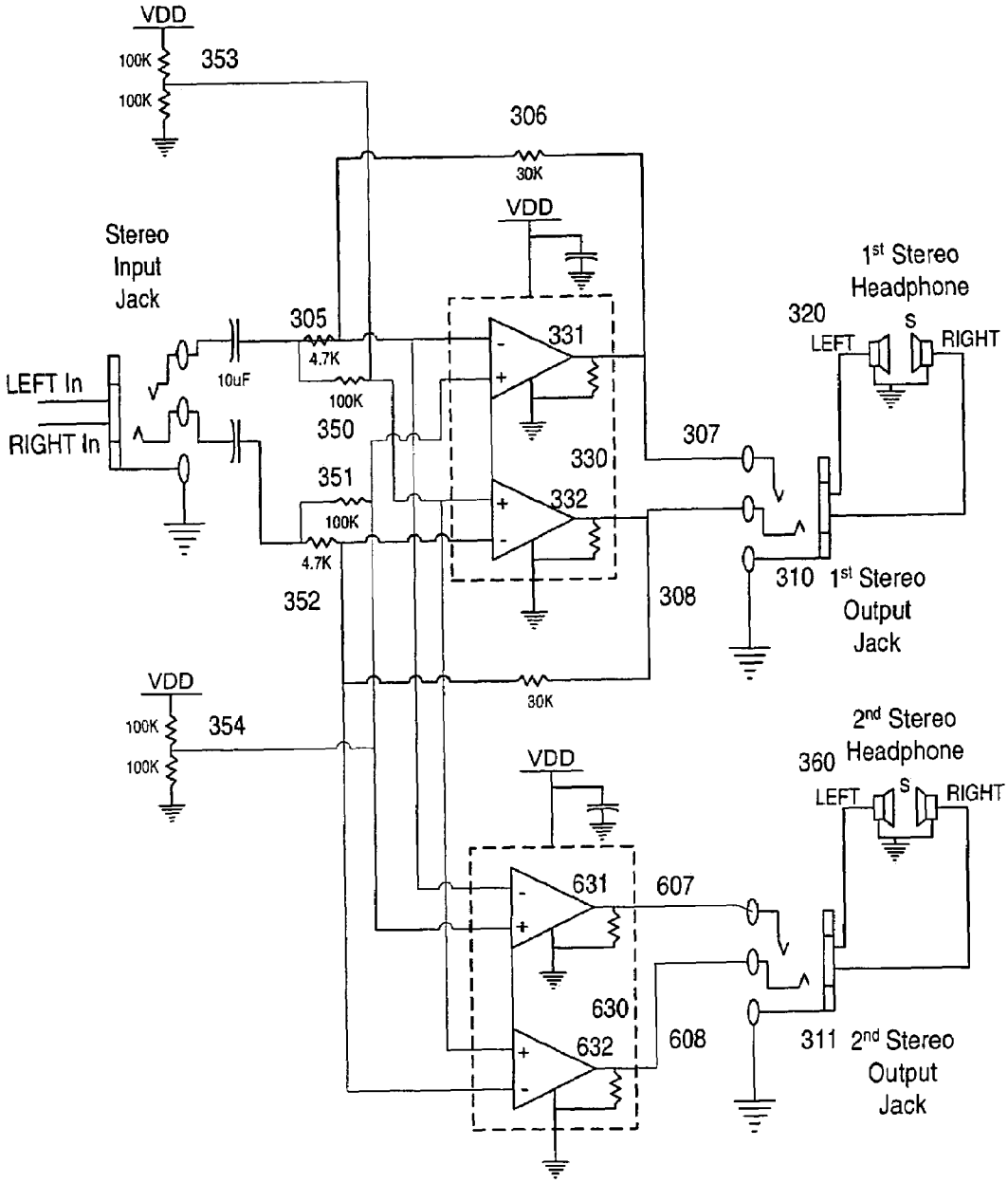
FIG. 6 is a block diagram illustrating multiple outputs from the amplifying and enhancement circuitry with each output driven by an associated output driver.

FIG. 6 is a block diagram illustrating a circuit similar to that in FIG. 3 but with multiple outputs from the amplifying and enhancement circuitry each driven by an associated output driver. FIG. 6 is identical to FIG. 3 except that the outputs 307 and 308 from operational amplifier package 330 drive only output jack 310. There are now output connections 607 and 608 for the second output stereo jack 311 and second stereo headphone 360 which are driven by an independent stereo amplifier circuit 630 with independent operational amplifiers 631 and 632. The inputs to these operational amplifiers in package 630 are driven by the same signals as used to drive the operational amplifier package 330 for the first stereo output jack 310. This includes inputs for both the stereo signals from resistors 305 and 352 and also the reference voltages 353 and 354. This circuit has the advantage for listeners that the stereo headphone outputs from jacks 310 and 311 may be driven independently of each other so that the impedance of either headphone 320 or 360 does not affect the listening volume or sound quality of any other headphone. Thus, the circuit may utilize a second stereo driver circuit 630 requiring additional power while the circuit board and housing may also have to be slightly larger appearance to accommodate any added integrated circuit package.

In conclusion, the invention is directed to a device for amplification and enhancement of a multi-channel signal from a personal listening device where an audio steering arrangement is used to control the amount of in-phase and out of phase audio perceived by the listener so as to change the perception of vocals, instruments and/or other sounds in recorded audio.

While the principles of the invention have now been made clear in an illustrative embodiment, it shall be evident to those skilled in the art that modifications of structure, arrangements, proportions, the elements, materials, and components, used in the practice of the invention may be adapted for other specific environments and operating requirements without departing from the spirit and scope of the invention.

What is claimed is:

1. A device for enhancing a multi-channel signal from a personal listening device comprising:

A) means for routing a multi-channel input signal from outside the case of the device to internal circuitry of the device, the multi-channel input signal is a stereo signal, the means for routing an input signal to the internal circuitry is an input jack, and the output connectors are headphone jacks;

B) internal circuitry including means for providing a cross-feed signal between at least two channels of the multi-channel signal with the signal of the cross-feed being a function of the signal for another channel, the internal circuitry utilizes fixed resistors for determining the ratio of cross-feed between the stereo channels with the values of the resistors such that the percentage of cross-feed from each channel to another is between three and ten percent of the input signal; and C) means for routing a multi-channel output signal from the internal circuitry of the device to a plurality of output connectors such that provision is made for more than one listener to listen to the multi-channel signal.

2. The device of claim 1 where the internal circuitry including the cross-feed function is implemented using two op-amps with each op-amp utilizing only one positive and only one negative input.

3. The device of claim 1 where the internal circuitry is powered by batteries with mounting apparatus for holding the batteries oriented such as to align the batteries end to end thus allowing the overall packaging of the device to have the look and feel of being an extended part of the cord connecting the device to any external headphones.

4. The device of claim 1 where the internal circuitry is powered by batteries with the mounting apparatus for holding the batteries oriented such as to hold the batteries side by side thus allowing the overall containing package of the device to be conveniently carried.

5. The device of claim 1 with each output connector driven by its own amplification circuit.

6. The device of claim 1 with at least two of the output connectors being connected in parallel and driven by a single amplification circuit.

7. A device for enhancing a multi-channel signal from a personal listening device comprising:

A) means for routing a multi-channel input signal from outside the case of the device to internal circuitry of the device;

B) internal circuitry including means for providing a cross-feed signal between at least two channels of the multi-channel signal with the signal of the cross-feed being a function of the signal for another channel, the internal circuitry utilizes fixed resistors for determining the ratio of cross-feed between the stereo channels with the values of the resistors such that the percentage of cross-feed from the difference signal to each channel is between three and ten percent of the input signal; and C) means for routing the multi-channel output signals from the internal circuitry of the device to an output connector.

8. The device of claim 7 where the internal circuitry including the cross-feed function is implemented using two op-amps with each op-amp utilizing only one positive and only one negative input.

9. The device of claim 7 where the internal circuitry is powered by batteries with mounting apparatus tor holding the batteries oriented such as to align the batteries end to end thus allowing the overall packaging of the device to have the look and feel of being an extended part of the cord connecting the device to any external headphones.

10. The device of claim 7 where the internal circuitry is powered by batteries with the mounting apparatus for holding the batteries oriented such as to hold the batteries side by side thus allowing the overall containing package of the device to be carried conveniently in a pocket or purse.

* * * * *